US007478726B2

(12) United States Patent
Apps et al.

(10) Patent No.: US 7,478,726 B2
(45) Date of Patent: Jan. 20, 2009

(54) COLLAPSIBILE CRATE WITH SUPPORT MEMBERS

(75) Inventors: William P. Apps, Alpharetta, GA (US); Cynthia R. Aiken, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 1224 days.

(21) Appl. No.: 10/156,677

(22) Filed: May 28, 2002

(65) Prior Publication Data

US 2003/0222081 A1 Dec. 4, 2003

(51) Int. Cl.
*B65D 21/032* (2006.01)

(52) U.S. Cl. ..... 206/506; 220/6; 220/7

(58) Field of Classification Search ..... 206/506, 206/511, 512, 600; 220/6, 7, 4.28
See application file for complete search history.

(56) References Cited

U.S. PATENT DOCUMENTS

| | | | | |
|---|---|---|---|---|
| 1,689,217 | A | 10/1928 | White | |
| 2,134,875 | A | 11/1938 | Henze | |
| 3,220,603 | A | 11/1965 | Bromley | |
| 3,895,715 | A * | 7/1975 | Drader | 206/506 |
| 3,904,066 | A * | 9/1975 | Wilson | 220/7 |
| 3,951,265 | A | 4/1976 | Carroll | |
| 4,106,623 | A | 8/1978 | Carroll et al. | |
| 4,109,791 | A | 8/1978 | Clipson et al. | |
| 4,241,831 | A | 12/1980 | Locatelli | |
| 4,247,004 | A | 1/1981 | Bird | |
| 4,391,369 | A | 7/1983 | Stahl et al. | |
| 4,423,813 | A | 1/1984 | Kreeger et al. | |
| 4,466,541 | A | 8/1984 | Tabler et al. | |
| 4,573,577 | A | 3/1986 | Miller | |
| RE32,223 | E | 8/1986 | Kreeger et al. | |
| 4,643,310 | A | 2/1987 | Deaton | |
| 4,759,451 | A | 7/1988 | Apps | |
| 4,848,578 | A | 7/1989 | Schafer | |
| 4,863,062 | A | 9/1989 | Holliday | |

(Continued)

FOREIGN PATENT DOCUMENTS

| | | |
|---|---|---|
| DE | 35 11 321 | 10/1986 |

(Continued)

OTHER PUBLICATIONS

Translation of DE 19939019 (PTO 06-5039), Jun. 2006.*

*Primary Examiner*—Stephen Castellano
(74) *Attorney, Agent, or Firm*—Carlson, Gaskey & Olds

(57) ABSTRACT

A collapsible crate includes a plurality of retractable supports movable from a retracted position generally within a first wall to a support position generally diagonally across the corner, wherein the support is supported in the first end by the first wall and a second end by the second wall. This support includes a first guide at the first end, the first guide being pivotally and slideably captured by a first track in the first wall. The support also includes a second guide at an opposite second end, the second guide being slideably and pivotally captured by a second track in the first wall when the support is in the retracted position. The second guide is also slidable from the second track in the first wall to a third track in the adjacent second wall to move the support from the retracted to the support position.

17 Claims, 9 Drawing Sheets

U.S. PATENT DOCUMENTS

| | | | | |
|---|---|---|---|---|
| 4,905,833 | A | 3/1990 | Kreeger et al. | |
| 4,947,992 | A | 8/1990 | Schafer | |
| 5,083,666 | A | 1/1992 | Lam | |
| 5,494,163 | A | 2/1996 | Apps | |
| 5,609,254 | A * | 3/1997 | Loftus et al. | 206/506 |
| D381,203 | S | 7/1997 | Ackermann | |
| 5,772,033 | A * | 6/1998 | Loftus et al. | 206/506 |
| 5,975,324 | A | 11/1999 | Schmitt | |
| 6,015,056 | A | 1/2000 | Overholt et al. | |
| 6,098,827 | A | 8/2000 | Overholt et al. | |
| 6,142,329 | A | 11/2000 | Dotan | |
| 6,286,701 | B1 | 9/2001 | Umiker | |
| 6,290,081 | B1 | 9/2001 | Merey | |
| 6,382,458 | B2 * | 5/2002 | Mori | 220/763 |
| 6,386,388 | B1 | 5/2002 | Overholt | |
| 6,398,054 | B1 | 6/2002 | Overholt et al. | |
| 6,405,888 | B1 | 6/2002 | Overholt et al. | |
| 6,409,041 | B1 | 6/2002 | Overholt et al. | |
| 6,460,717 | B1 | 10/2002 | Smyers et al. | |
| 6,581,330 | B1 | 6/2003 | Helsloot et al. | |
| 6,631,822 | B1 | 10/2003 | Overholt | |
| 2003/0132228 | A1 | 7/2003 | Apps et al. | |

FOREIGN PATENT DOCUMENTS

| | | |
|---|---|---|
| DE | 35 21 894 | 1/1987 |
| DE | 199 39 019 A1 | 2/2001 |
| DE | 200 02 537 U1 | 7/2001 |
| EP | 0 073 357 | 3/1983 |
| EP | 0 385 914 | 9/1990 |
| EP | 0 404 041 | 12/1990 |
| EP | 1 114 779 | 7/2001 |
| GB | 2 129 401 | 5/1984 |
| GB | 2 141 778 | 1/1985 |
| GB | 2 171 980 | 9/1986 |
| NL | 790 5105 | 6/1979 |
| WO | WO 97 49613 | 12/1997 |
| WO | WO 00/27716 | 5/2000 |
| WO | WO 00/66440 | 11/2000 |

* cited by examiner

COLLAPSIBILE CRATE WITH SUPPORT MEMBERS

BACKGROUND OF THE INVENTION

The present invention relates generally to collapsible crates and more particularly to a collapsible crate with retractable support members for supporting another container thereon.

Collapsible crates are well known. Four walls each connected via a hinge to a base are selectively movable about the hinge between a use position, in which the wall is generally perpendicular to the base, and a collapsed position onto the base. Various mechanisms have been provided to connect adjacent walls at the corner to selectively lock the crate in the use position.

International application WO 00/66440 discloses a collapsible container with flap members arranged at an upper edge of two opposing walls. The flap members are attached to the upper edge via hinges and may be swung between an outward position and an inward position. In the inward position, the flap members act as a stacking ledge for containers stacked on top of the collapsible container; however, the flap members may interfere with ease with which the crate can be collapsed.

SUMMARY OF THE INVENTION

The present invention provides a collapsible crate with retractable support members which are selectively movable between a retracted position and a support position. In the retracted position, each support member is disposed within one of the walls. In the support position, the support member extends diagonally across a corner and is supported at opposite ends by adjacent walls. Preferably, the support member includes a first guide at a first end of the support member and a second guide at an opposite second end of the support member. The first guide is slideably captured by a first track in the first wall. The second guide is slideably captured by a second track in the first wall when in the retracted position and slidable into a track on the adjacent second wall into the support position. Preferably, support members are provided at each of the corners of the collapsible crate.

In the method of the present invention, the support member is moved from the retracted position in the first wall to the support position where it is supported by the first wall and the adjacent second wall. In the support position, the support extends diagonally from the first wall to the second wall. The method further includes the step of placing a second crate on the first crate, wherein the second crate is at least partially supported by the support member in the support position.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE INVENTION PREFERRED EMBODIMENTS

Figure 1:
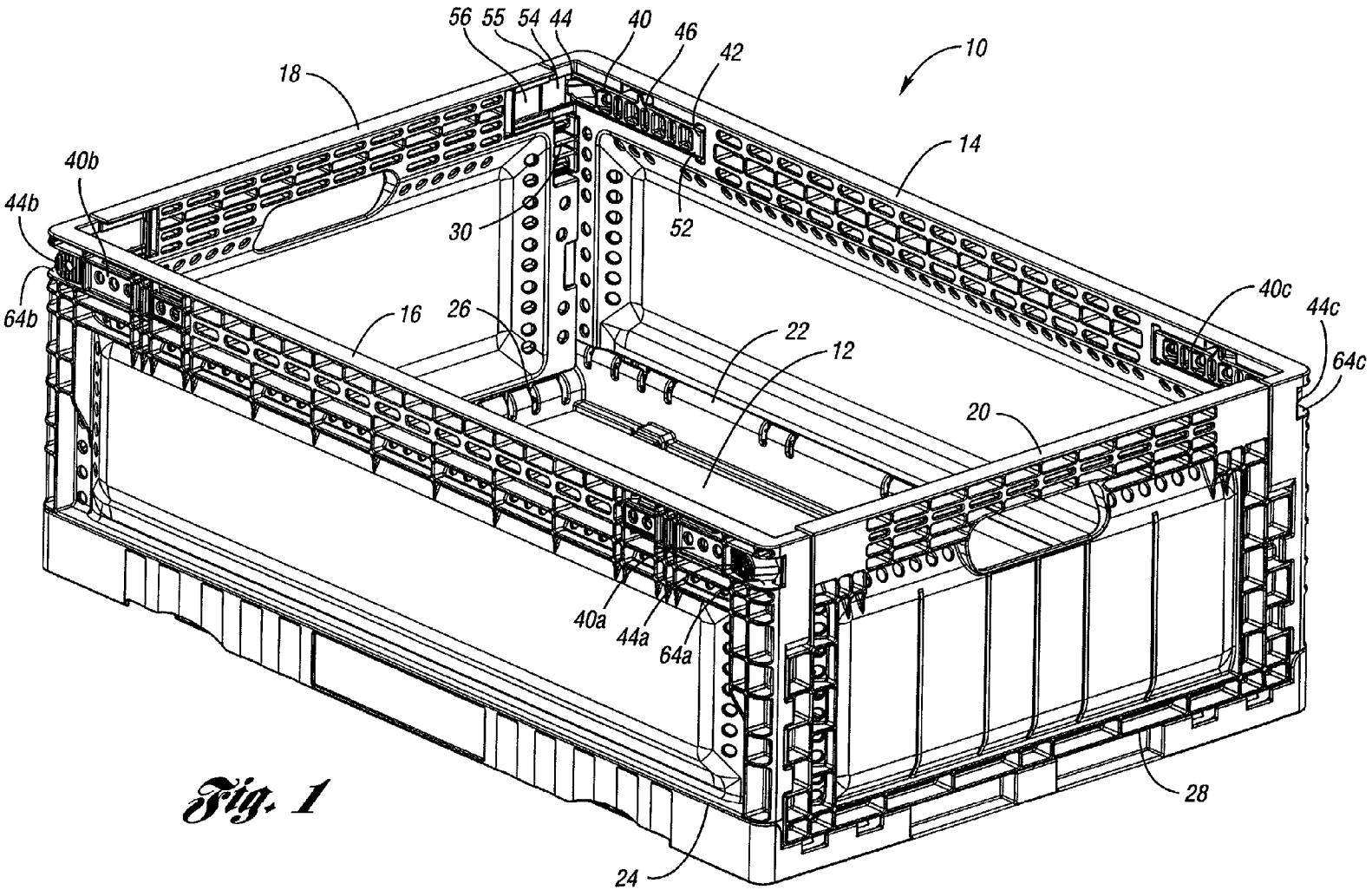
FIG. 1 is perspective view of a collapsible crate with retracted support members according to the present invention.

A collapsible crate 10 according to the present invention is illustrated in FIG. 1. The assembled collapsible crate 10 includes a base wall 12 and upstanding perpendicular side walls 14, 16 and end walls 18, 20. The side walls 14, 16 are connected to the base wall 12 by hinges 22, 24, respectively. End walls 18, 20 are similarly connected to the base wall 12 via hinges 26, 28, respectively. As is known, the side walls 14, 16 and end walls 18, 20 are collapsible inwardly by pivoting at hinges 22, 24, 26, 28 onto base wall 12. The crate 10 can be collapsed for shipping or storage and can be quickly set up by pivoting side walls 14, 16 and end walls 18, 20 about their respective hinges 22, 24, 26, 28 to the use position, generally perpendicular to base wall 12. The side walls 14, 16 may then be latched to adjacent end walls 18, 20 at the corners using any of a variety of latches, such as the latch 30 connecting side wall 14 to end wall 18 in FIG. 1.

The present invention provides a plurality of support members 40, 40*a*, 40*b*, 40*c* for selectively supporting another container thereon. For clarity, support member 40 will be described primarily; however, all of the support members are identical or mirror images. In FIG. 1, the support member 40 is shown in the retracted position, disposed within side wall 14. The support member is generally an elongated beam having a first end 42 and an opposite second end 44. A tab 46 for engaging a bottom surface of another container (shown in FIG. 6) protrudes from the top surface of the support member 40. The first end 42 of the support member 40 is slideably and pivotally captured within a track 52 in side wall 14. Similarly, the second end 44 of the support member 40 is slideably and pivotally captured within a track 54 in a generally perpendicular extension 55 from side wall 14. As can be seen in FIG. 1, the second track 54 in the extension 55 of side wall 14 is aligned with a third track 56 in adjacent end wall 18.

Referring to support member 40*a* in FIG. 1, and again noting that all of the support members are identical (or mirror images), it can be seen that the second end 44*a* of the support member 40*a* is visible and accessible through an aperture 64*a* through side wall 16. As will be described more fully below, the user can selectively move the support member 40*a* from the retracted position (shown) to the use position by pressing on the second end 44*a* through the aperture 64*a* to move the support member 40*a* to the use position as shown in FIG. 2.

Figure 2:
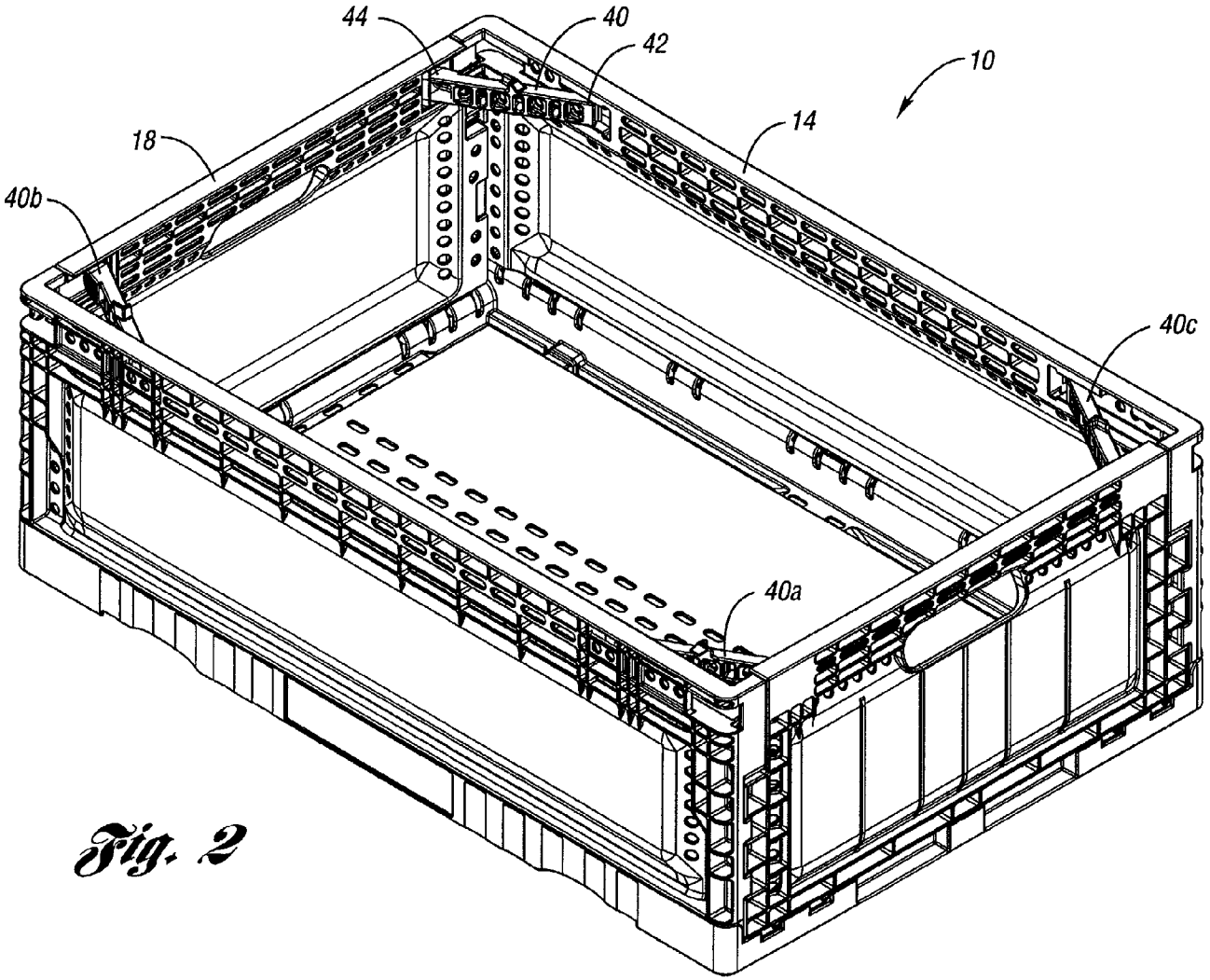
FIG. 2 is the collapsible crate of FIG. 1 with the support members in the support position.

In FIG. 2, all of the support members 40, 40*a*, 40*b*, 40*c* have been moved to the use position. Support member 40 extends generally diagonally across the corner between side wall 14 and end wall 18, with the first end 42 of support member 40 being supported within side wall 14 and the second end 44 of the support member 40 being supported within the end wall 18. In this position, another container (shown in FIG. 6) can be supported on the support members 40, 40*a*, 40*b*, 40*c*.

Figure 3:
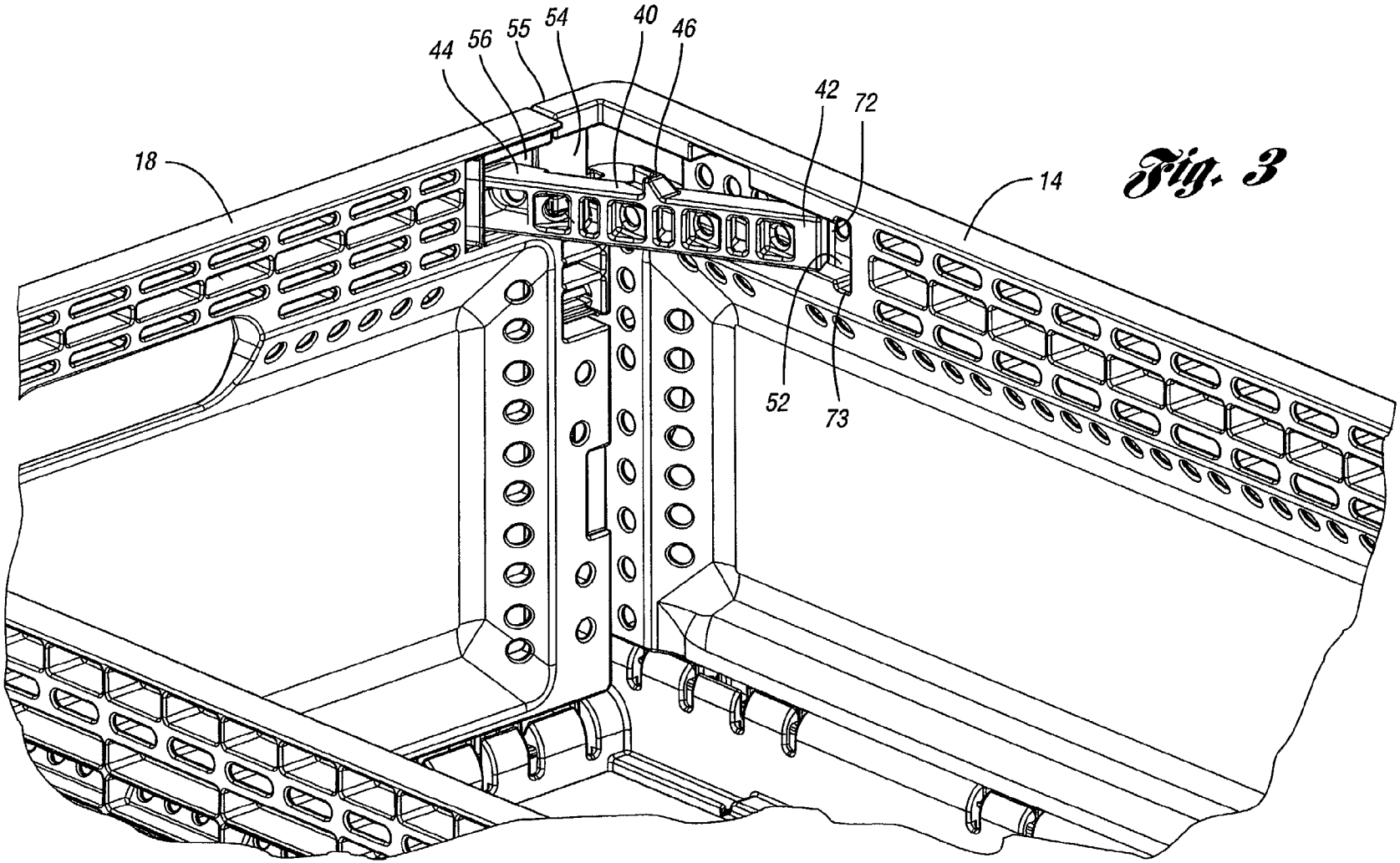
FIG. 3 is an enlarged view of one of the support members in one of the interior corners of the crate of FIG. 2.

FIG. 3 is an enlarged view of the support member 40 in FIG. 2 in the support position. As can be seen more clearly in FIG. 3, the first end 42 of the support member 40 includes a transverse pin 72 captured in the track 52 in side wall 14. The support member 40 also pivots on pin 72 as the pin 72 slides within track 52. The track 52 includes an enlarged aperture 73 through which the pin 72 can be inserted and removed for assembly or removal of the support member 40 from the side wall 14. The second end 44 of support member 40 has been slid from the second track 54 on side wall 14 to the third track 56 on end wall 18.

Figure 4:
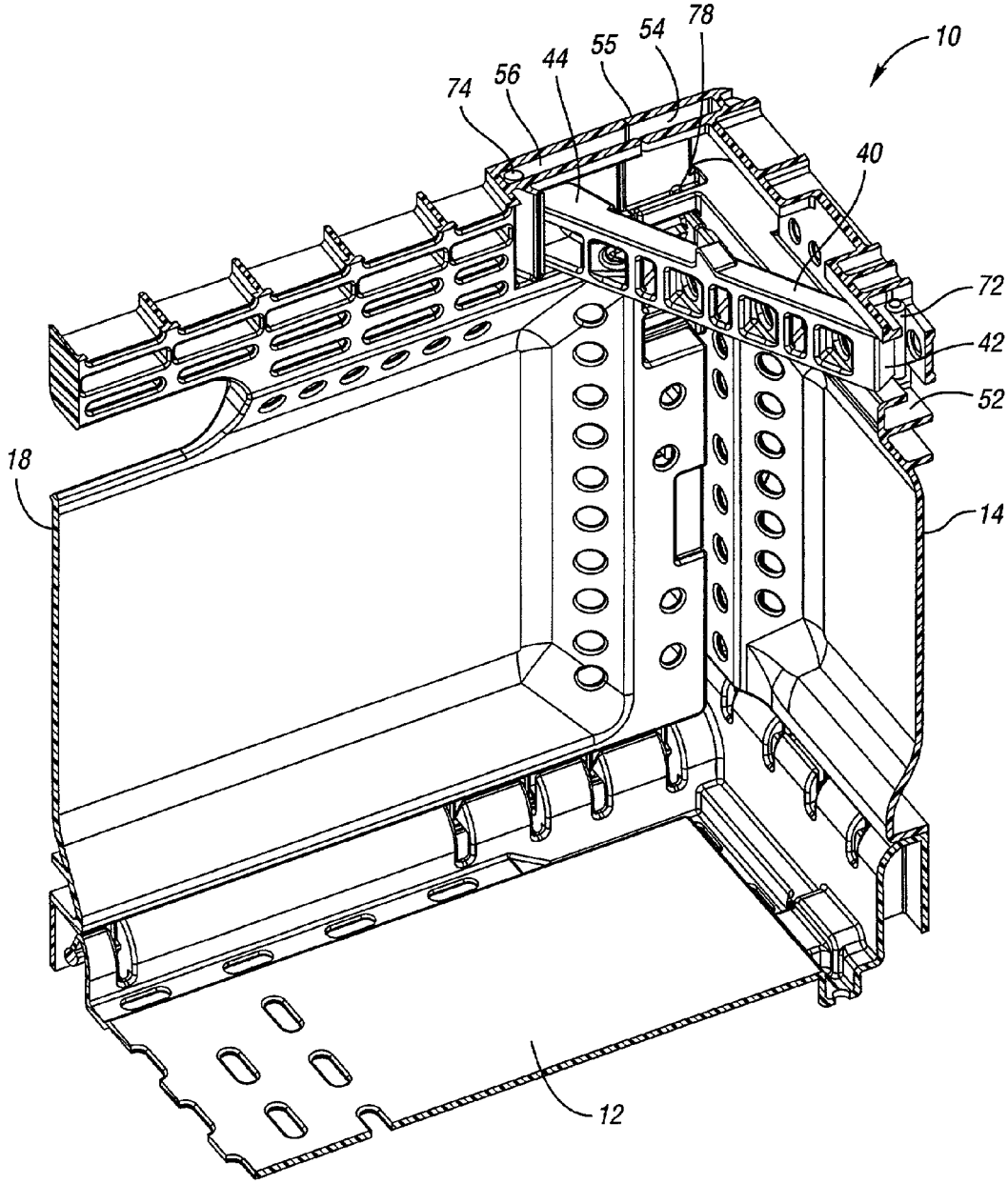
FIG. 4 is the collapsible crate of FIG. 3 with the upper edge of the crate partially broken away.
Figure 5:
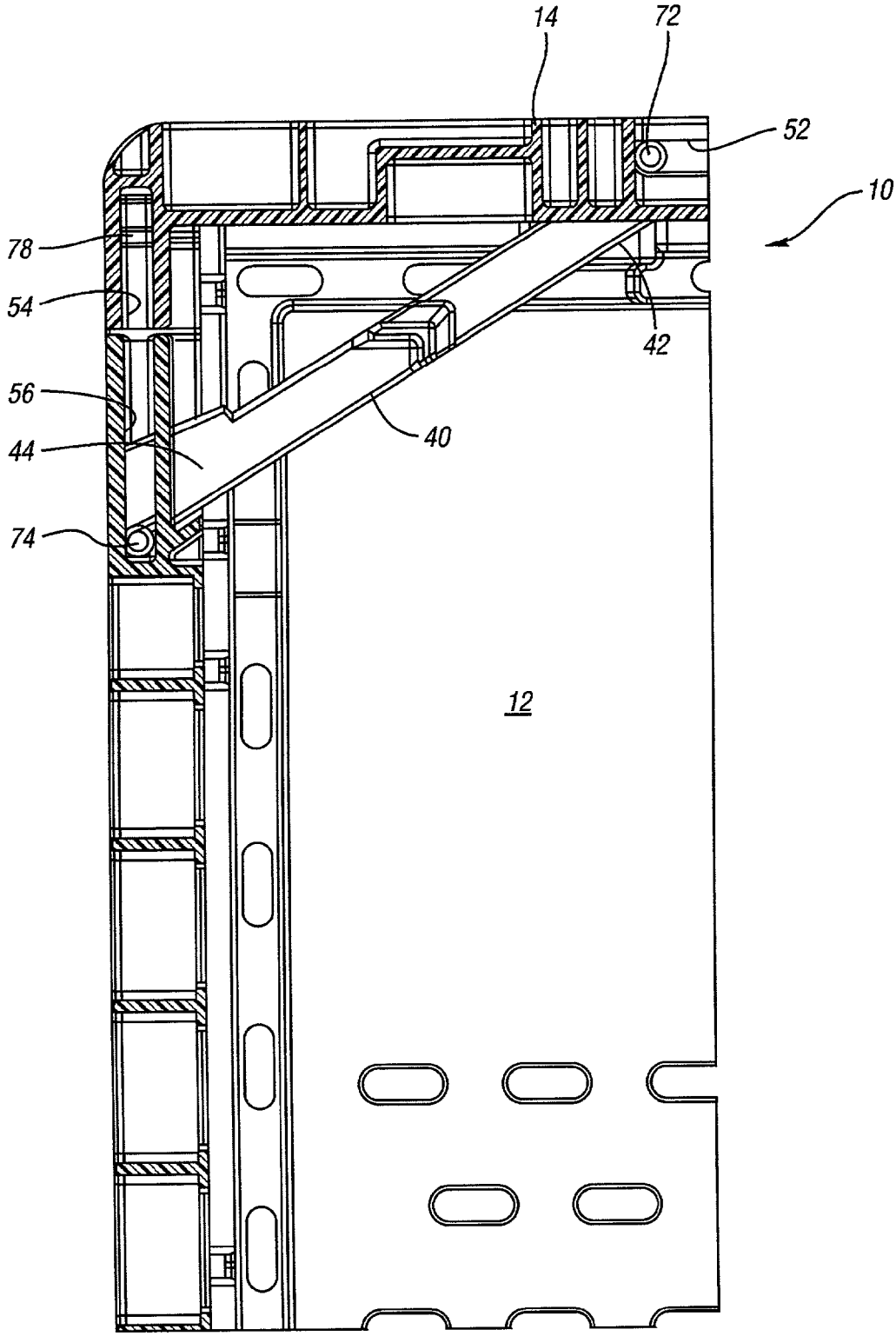
FIG. 5 is a top view of the collapsible crate of FIG. 4, with the upper edge of the crate partially broken away.

FIGS. 4 and 5 illustrate the support member 40, side wall 14 and end wall 18 with the upper portion of side wall 14 and end wall 18 broken away. The pin 72 is captured within the first track 52 in side wall 14. The second end 44 of support member 40 also includes a pin 74 which is captured by the third track 56 in end wall 18. The second track 54 in side wall 14 is aligned with the third track 56 in end wall 18, such that a pin 74 at the second end 44 of support member 40 can slide between the second track 54 and the third track 56. The second track 54 includes a detent 78 which engages the pin 74 at the second end 44 of the support member 40 when the support member 40 is in the retracted position.

Figure 6:
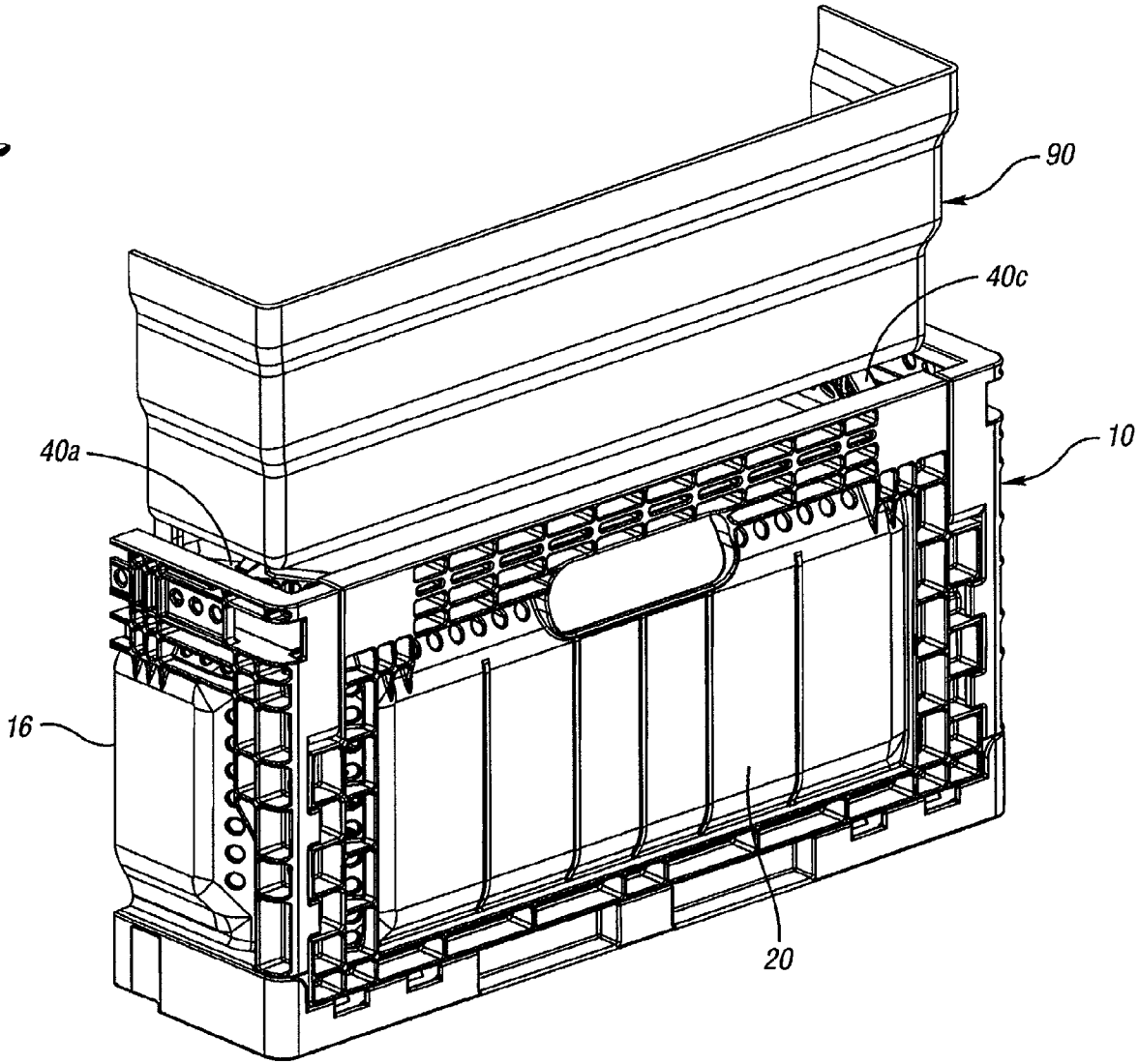
FIG. 6 illustrates the collapsible crate with the support members in the support position and a second crate stacked thereon.

FIG. 6 illustrates the collapsible crate 10 with the support members (support members 40*a* and 40*c* shown) in the support position. In this position another container, such as container 90, can be stacked on top of collapsible crate 10 supported by the support members (only support members 40*a* and 40*c* shown).

Figure 7:
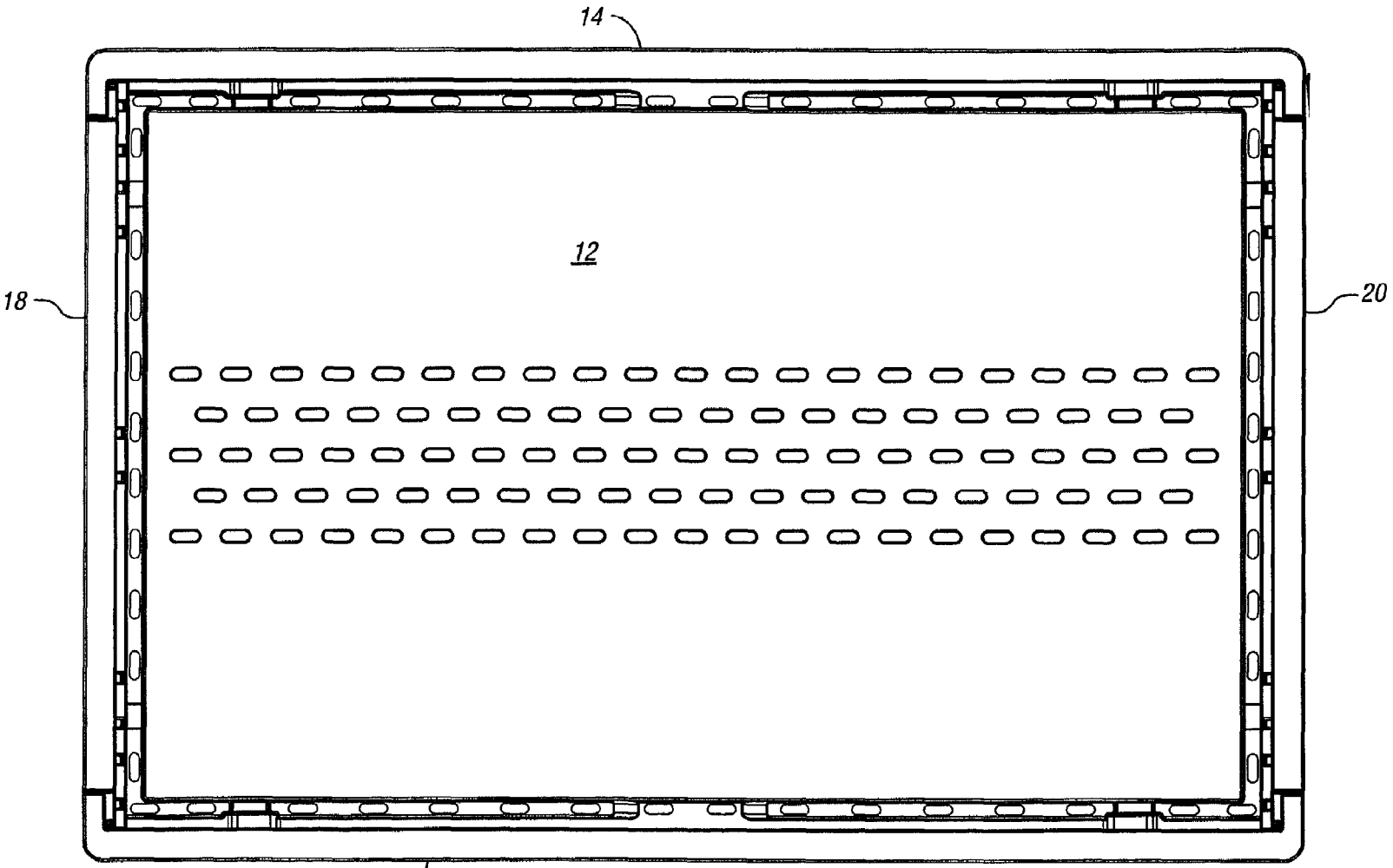
FIG. 7 is a top view of the collapsible crate of FIG. 1, with the support members in the retracted position.
Figure 8:
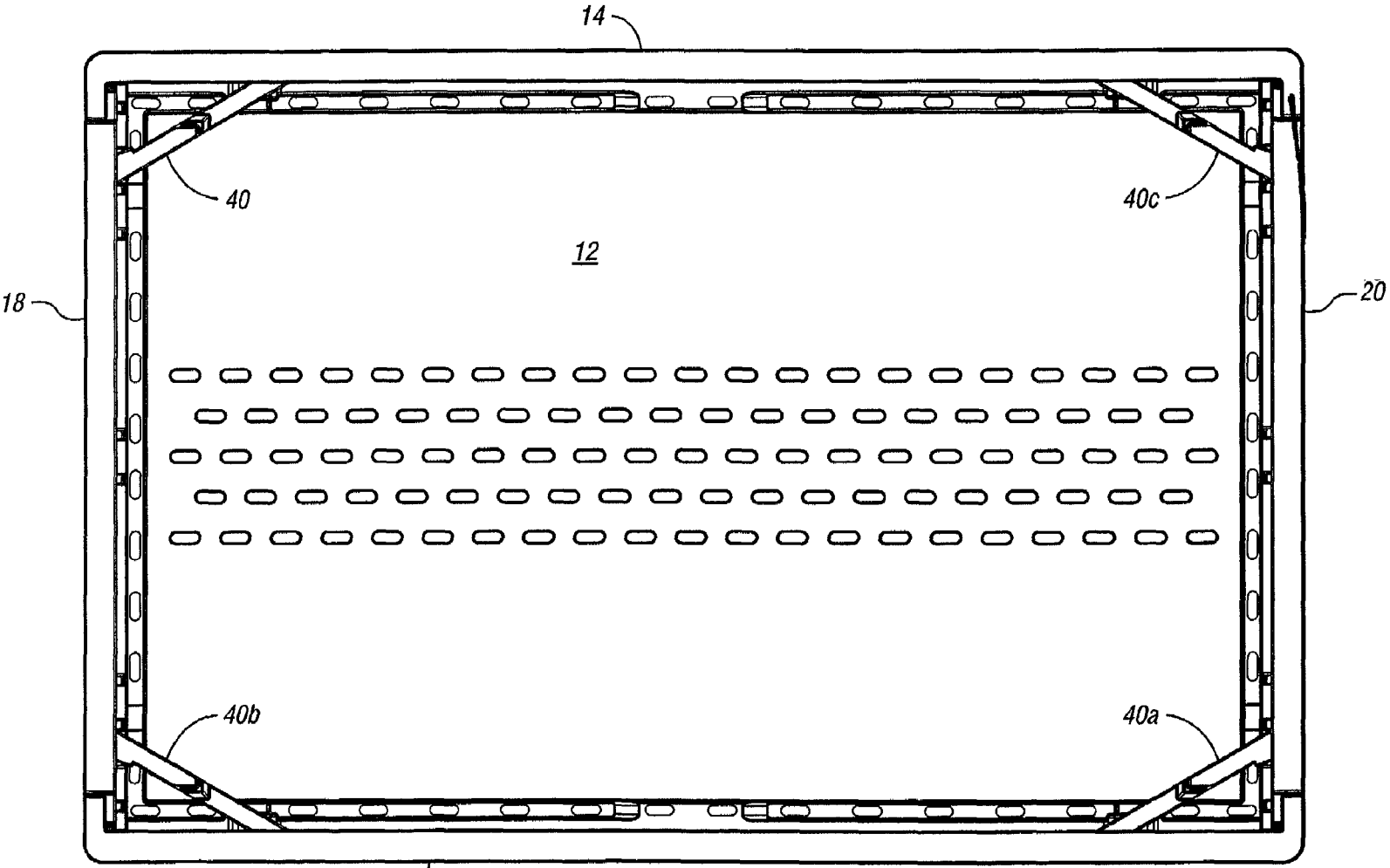
FIG. 8 is the collapsible crate of FIG. 7 with the support members in the support position.
Figure 9:
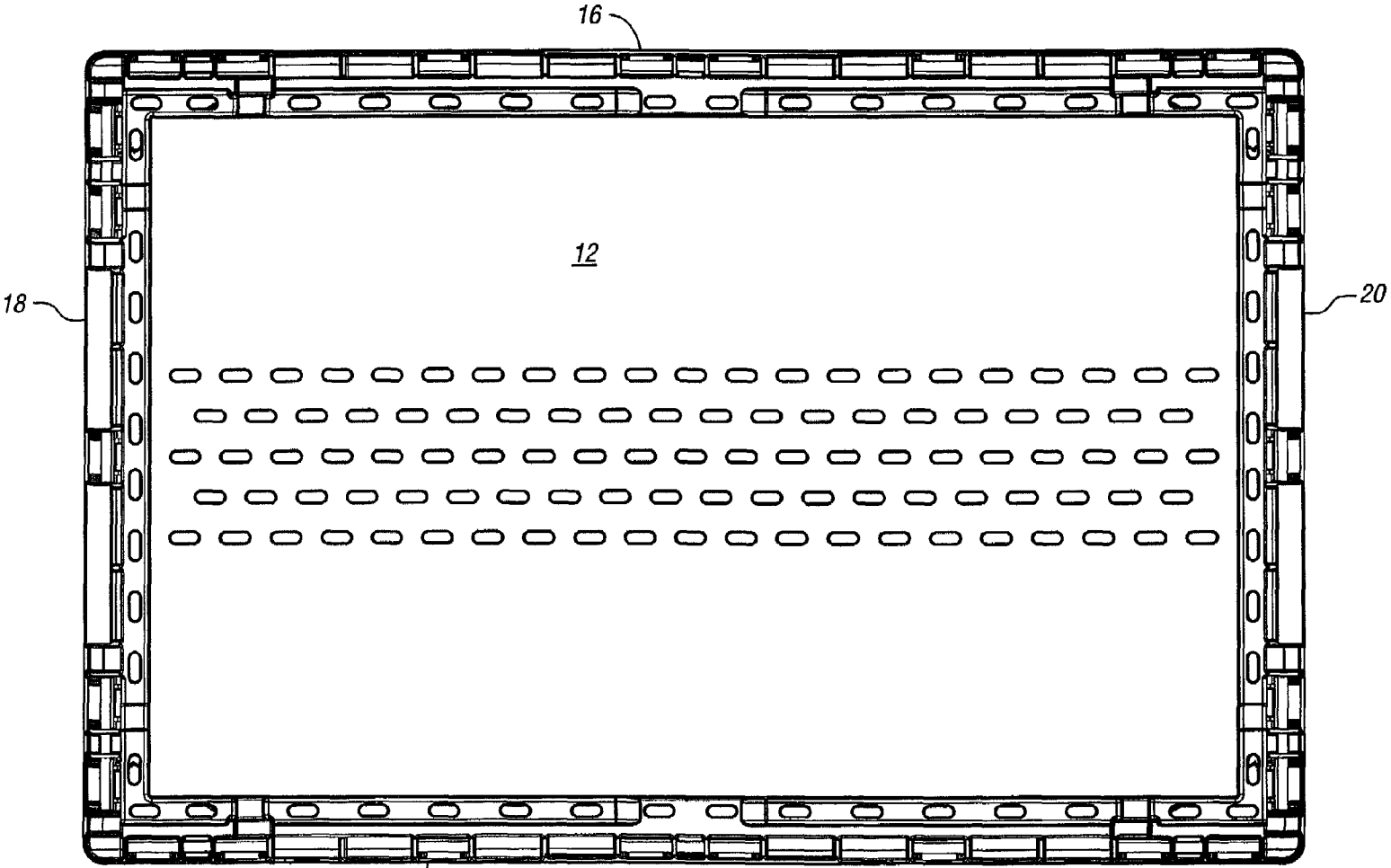
FIG. 9 is a bottom view of the collapsible crate of FIG. 8.

FIG. 7 is a top view of the collapsible crate with the support members (not visible) in the retracted position. FIG. 8 is a top view of the collapsible crate in FIG. 7 with the support members 40, 40*a*, 40*b*, 40*c* shown in the support position. FIG. 9 is a bottom view of the collapsible crate in FIG. 8.

In use, the collapsible crate is first configured to its use position as shown in FIG. 1 with the side walls 14, 16 and end walls 18, 20 moved to their upright position, generally perpendicular to the base 12 and secured by latch 30. The user then presses the second end 44 of the support member 40 inward from the outside of the container. A textured thumb actuation surface may be provided on the support member 40 to enhance actuation. Referring to FIG. 4, this causes pin 74 to slide in second track 54 of the side wall 14 into the third track 56 of the end wall 18. Meanwhile the pin 72 on the first end 42 on the support member 40 slides and pivots within the first track 52 of the side wall 14 until the support member 40 extends diagonally (i.e. at an oblique angle) from the side wall 14 to the end wall 18. This process is repeated for the other three support members 40*a, b, c*.

In this position the other container 90 can be stacked on top of collapsible crate 10, supported by the support members 40, 40*a, b, c* (FIG. 6). Again referring to FIG. 4, after use and prior to shipping or storage of the container, the crate 10 can be collapsed again by first sliding the support members 40 from the support position back to the retracted position within side wall 14. Support member 40 is placed in the retracted position by pushing on the inner surface of support member 40, sliding pin 74 through the third track 56 and second track 54 into the fully retracted position. The end walls 18, 20 and side walls 14, 16 are then collapsed onto the base 12 in the normal manner without interference by the support members 40.

In general, in the support position, the support member 40 is supported at one end by a first wall and at the opposite end by a perpendicular second wall such that the support member 40 extends at an oblique angle (i.e. diagonally) across the corner. Referring to the particular embodiment shown in the Figures, the "second wall" could be the perpendicular extension 55 extending from the side wall 14, such that the opposite end of the support member 40 is supported by the perpendicular extension 55. In other words, and referring specifically to FIG. 3, in the support position the second end 44 of the support member 40 could simply be supported within second track 54 in the extension 55, in which case the third track 56 in end wall 18 could be omitted (as an alternate design).

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric labels on method steps are for the purpose of clarifying references in dependent claims and unless otherwise specified do not signify a specific sequence in which the steps are to be performed.

What is claimed is:

1. A crate comprising:

a base wall;

a first wall generally perpendicular to the base wall;

a second wall generally prependicular to the base wall and the first wall;

a retractable support having a first end pivotably and slidably connected to the first wall, the support pivotable about the first end about an axis not parallel to the base wall from a retracted position generally parallel to the first wall to a support position where the support is supported at the first end by the first wall and at a second end by the second wall; and in the retracted position, the second end of the support is nearer to the second wall than the first end of the support is to the second wall.

2. The crate of claim 1 wherein the support includes a first guide at the first end and a second guide at the second end, the first guide being captured by a first track in the first wall and slidable in the first track, the second guide being captured by a second track in the first wall and slidable in the second track in a direction generally parallel to the first wall.

3. A crate comprising:

a base wall;

a first wall generally perpendicular to the base wall;

a second wall generally perpendicular to the base wall and the first wall;

a retractable support having a first end pivotably and slidably connected to the first wall, the support pivotable about the first end about an axis not parallel to the base wall from a retracted position generally parallel to the first wall to a support position where the support is supported at the first end by the first wall and at a second end by the second wall; and the support includes a first guide at the first end and a second guide at the second end, the first guide being captured by a first track in the first wall and slidable in the first track, the second guide being captured by a second track in the first wall and slidable in the second track.

4. The crate of claim 3 wherein the second guide is slidable between the second track when the support is in the retracted position to a third track in the second wall when the support is in the support position.

5. The crate of claim 4 wherein the crate is a collapsible crate wherein the first and second walls are pivotable about hinges on the base wall between a collapsed position generally parallel to the base wall and an open position generally perpendicular to the base wall.

6. A collapsible crate comprising:

a base wall;

a first wall movable about a first hinge between a collapsed position generally parallel to the base wall and a use position generally perpendicular to the base wall;

a second wall movable about a second hinge between a collapsed position generally parallel to the base wall and a use position generally perpendicular to the base wall, the second hinge generally perpendicular to the first hinge; and a retractable support selectively pivotable by an acute angle between a retracted position generally parallel to and within the first wall to a support position where the support extends diagonally from a first end supported by the first wall to a second end supported by the second wall.

7. The crate of claim 6 wherein the first end of the support in the support position is supported in the first wall, and the second end of the support is supported in the second wall.

8. The crate of claim 7 wherein the support includes a first guide at the first end and a second guide at the second end, the first guide being captured by a first track in the first wall and slidable in the first track, the second guide being captured by a second track in the second wall and slidable in the second track.

9. The crate of claim 8 wherein the second guide is slidable between the second track when the support is in the support position to a third track in the first wall when the support is in the retracted position.

10. A collapsible crate comprising:

a base;

a first wall movable about a first hinge between a collapsed position generally parallel to the base wall and a use position generally perpendicular to the base wall;

a second wall movable about a second hinge between a collapsed position generally parallel to the base wall and a use position generally perpendicular to the base wall, the second hinge generally perpendicular to the first hinge; and a retractable elongated support extending from a first end to a second end, the support selectively movable between a retracted position and a support position, wherein in the retracted position the support extends generally parallel to the first wall from a second end near the second wall to the first end away from the second wall, and wherein in the support position the support extends diagonally from the first end supported by the first wall to the second end supported by the second wall, wherein the support is not parallel to the first wall or the second wall in the support position.

11. The collapsible crate of claim 10 wherein the support includes a first guide at the first end and a second guide at the second end, the first guide being captured by a first track in the first wall and slidable in the first track, the second guide being captured by a second track in the second wall and slidable in the second track when the support is in the support position.

12. The crate of claim 11 wherein the second guide is slidable between the second track to a third track in the first wall to move the support from the support position to the retracted position.

13. The crate of claim 10 wherein the support is received within the first wall when the support is in the retracted position.

14. The crate of claim 10 wherein the support reduces a dimension of an opening of the crate when moved from the retracted position to the support position.

15. The crate of claim 10 wherein a space is defined between the support and an interior corner between the first and second walls when the support is in the support position.

16. The crate of claim 15 wherein the axis is perpendicular to the support.

17. The crate of claim 16 wherein the axis is at the first end of the support.

* * * * *